US006726401B1

(12) United States Patent
Potts

(10) Patent No.: US 6,726,401 B1
(45) Date of Patent: Apr. 27, 2004

(54) TREATMENT OF A LEACH FIELD

(76) Inventor: David A. Potts, 385 Roast Meat Hill Rd., Killingworth, CT (US) 06419

( * ) Notice: Subject to any disclaimer, the term of this patent is extended or adjusted under 35 U.S.C. 154(b) by 147 days.

(21) Appl. No.: 10/052,429

(22) Filed: Jan. 17, 2002

Related U.S. Application Data

(60) Provisional application No. 60/262,694, filed on Jan. 17, 2001.

(51) Int. Cl.[7] ..... B09B 3/00

(52) U.S. Cl. ..... 405/37; 405/36; 405/39; 405/43; 405/129.85; 210/747

(58) Field of Search ..... 210/747; 405/36, 405/37, 39, 43, 51, 129.85

(56) References Cited

U.S. PATENT DOCUMENTS 2,768,949 A * 10/1956 Hewey ..... 210/747
3,936,380 A * 2/1976 Boske ..... 210/170
4,021,338 A * 5/1977 Harkin ..... 210/747
4,429,647 A * 2/1984 Zinck ..... 111/118
4,838,731 A * 6/1989 Gavin ..... 405/40
4,923,333 A * 5/1990 Timmons ..... 405/129.5
5,200,065 A * 4/1993 Sinclair et al. ..... 210/104
5,202,027 A * 4/1993 Stuth ..... 210/615
5,360,556 A * 11/1994 Ball et al. ..... 210/804
5,383,974 A * 1/1995 Johnson ..... 134/21
5,827,010 A * 10/1998 Hassett ..... 405/36
6,018,909 A 2/2000 Potts ..... 47/58.1
6,162,020 A * 12/2000 Kondo ..... 417/54
6,406,627 B1 * 6/2002 Wallace ..... 210/602
6,485,647 B1 * 11/2002 Potts ..... 210/616
2003/0131886 A1 * 7/2003 Walker ..... 137/240

* cited by examiner

*Primary Examiner*—J. J. Swann
*Assistant Examiner*—Katherine Mitchell
(74) *Attorney, Agent, or Firm*—C. Nessler

(57) ABSTRACT

The performance of a leach field in processing waste water is maintained or improved by a control system in which one or more selected parameter in a waste water conduit, or in the influence zone of the conduit, is measured, compared to a set point(s), and one or more variable is manipulated. For example, gas composition, gas pressure, water level and water content are measured; waste water flow, heating, air flow and air composition are changed. In one mode of operation the manipulated variable is qualitatively different from the parameter being measured.

9 Claims, 1 Drawing Sheet

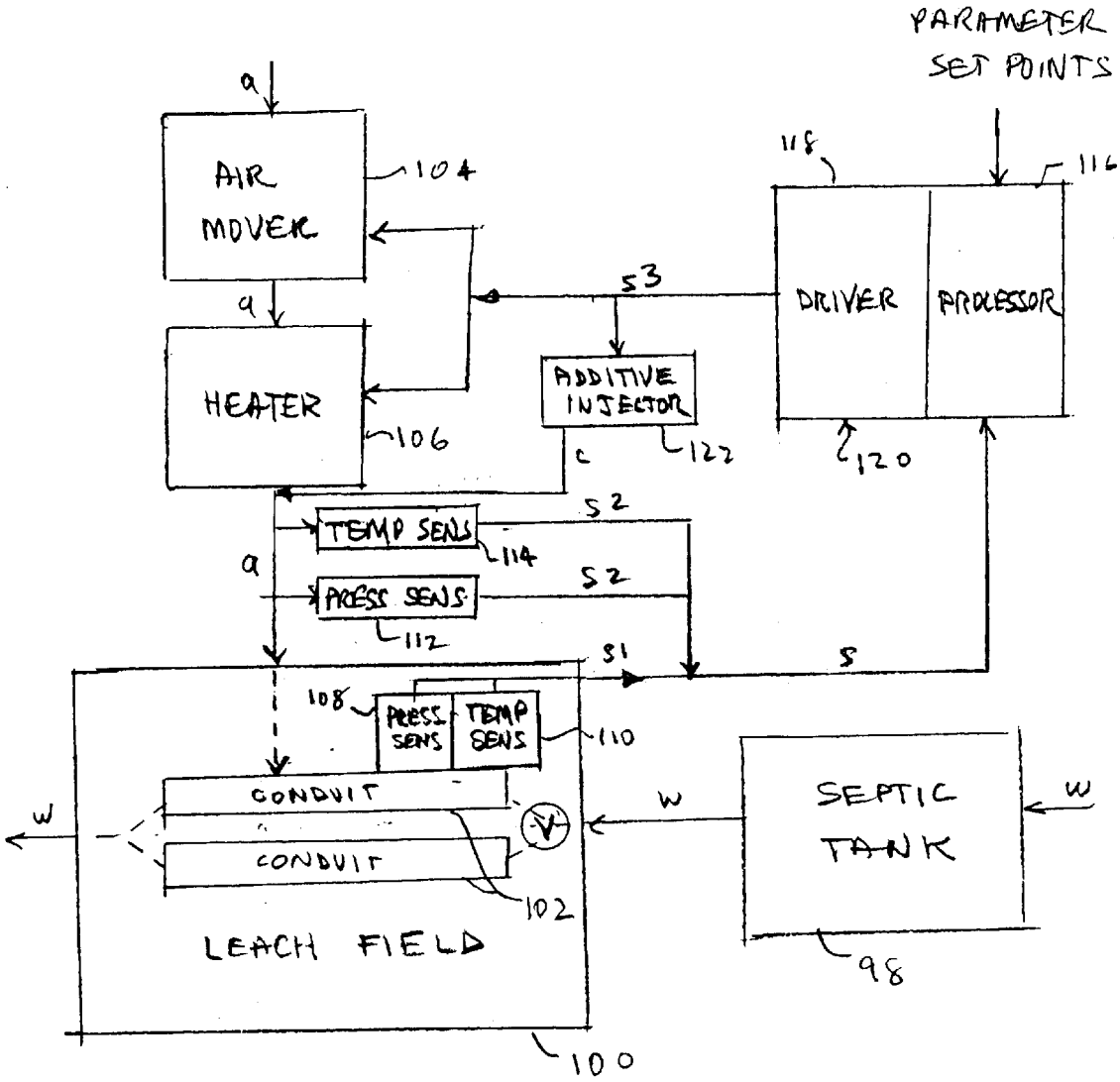
PARAMETER SET POINTS
a
AIR MOVER
104
118
116
DRIVER
PROCESSOR
S3
a
HEATER
106
ADDITIVE INJECTOR
122
c
120
TEMP SENS
114
S2
a
PRESS SENS
112
S2
S1
S
108
PRESS SENS
TEMP SENS
110
CONDUIT
CONDUIT
w
w
SEPTIC TANK
w
102
LEACH FIELD
98
100

TREATMENT OF A LEACH FIELD

This application claims benefit of provisional patent application Ser. No. 60/262,694, filed Jan. 17, 2001.

TECHNICAL FIELD

The present invention relates to subsurface waste water disposal, in particular to processing of waste water in a leach field.

BACKGROUND

In a waste water treatment system of the type commonly used for domestic dwellings and other limited volume waste water sources, waste water flows first via a sewer line into a primary treatment vessel, such as a septic tank, where it is acted upon by microorganisms in an anaerobic environment. The septic tank effluent, or waste water, then flows through a distribution box and piping to a leach field, for aerobic processing.

There are a variety of types of leach field constructions. Generally, they are characterized by some sort of excavation in the soil that may be a void or may be filled with gravel or crushed stone. In one common construction, perforated distribution pipes run along trenches filled with stone. In another, hollow concrete or plastic chambers or structures are used. Generally, the devices buried in the soil which convey waste water are referred to here as conduits. The conduits receive waste water, and temporarily store it until it infiltrates or disperses into the soil surrounding the conduit.

While seemingly simple in essential construction, the functioning or failing of a leach field, and its restoration, are not so simple. Ian properly functioning leach field biochemical activity makes the waste water environmentally benign. The region of the soil where the preponderance of such biochemical activity takes place is referred to as the influence zone. The influence zone typically extends outwardly from the sides and bottom of the conduit. Its nominal outer bound may vary as a function of many variables, including time, some of which are mentioned here.

A leach field should have sufficient capacity to receive and properly process the anticipated flow of waste water. The steady state capacity of a leach field for waste water flow, sometimes referred to as the percolation rate, is a function of various factors including the nature of the interface between the conduit and the soil and the nature of the surrounding soil, as such natures may have been affected by use of the leach field. Since waste water contains organic substances which are supposed to be oxidized or otherwise acted on by bacteria, conditions in the leach field may be such that, over time, there is an accumulation of such substances within the soil. Thus, the flow resistance or infiltration rate of a leach field will not simply be a function of the permeability, mechanics and hydraulics of the original soil.

In a properly functioning system, according to conventional thinking, the soil surrounding the conduits of a leach field ideally remains predominately unsaturated and aerobic, thus enabling oxidation and destruction of pathogenic bacteria. There can be local anaerobic regions. Nitrogen, discharged in human waste, passes through the influence zone predominantly as ammonium ($NH_4^+$), to be nitrified, or converted to nitrate ($NO_3$) form. Foreign constituents in the waste water may also sorb and or react with soil constituents. As the waste water is treated in the influence zone, it moves through the soil, typically toward the natural water table in the earth.

In a properly designed, used and maintained leach field, once biochemical equilibrium is reached, the capacity of the leach field typically remains stable insofar as waste water treatment capacity. However, too frequently, a system will demonstrate insufficient infiltration capacity with the passage of time, and will consider to be failed. The failure might be due to inadequate original design, or to over-use. In both cases, typically there is degradation with time of the capacity of the leach field to properly treat waste water, compared to when it was first installed. Failure of the leach field can be manifested by continuous or intermittent surfacing of inadequately treated waste water to the surface or elsewhere, by inadequate purification of the waste water in the field, or by refusal of the system to accept the ordinary waste water input. And, even if a system has not failed, it is desirable to guard against failure by having the greatest economically feasible margin of safety against failure.

In certain technologically related patent applications discussed further below, different techniques and devices are disclosed for improving, maintaining or correcting the performance of leach fields. There is a need for controlling those different processes and devices, so that the proper result is obtained in an efficient and economic manner, and interdependencies are dealt with. The present invention addresses that need.

SUMMARY

An object of the invention is to improve the performance of a leach field of a waste water system. A further object is to correct poor performance in a leach field, particularly one which at or near failure.

In accord with the invention, a leach field is treated by being subjected to controlled amounts of input, or manipulated variable, according to measurements of selected parameters in the field. In the leach field which comprises the conduit, influence zone and other soil, one or more parameter is measured, where the parameter is selected from the group comprising (a) composition of the gas within the soil (b) moisture content within the influence zone; (c) water level in the conduit; (d) gas pressure in the conduit or the soil; (e) temperature in the influence zone. The measured parameter is compared to a desired reference point for the parameter. And, then a manipulated variable is controlled by activation or change, to thereby cause the measured parameter to change in the direction of the desired reference point, where the manipulated variable is selected from the group comprising (a) flowing air or other active gas through the influence zone; (b) heating the influence zone; (c) heating air or other active gas which is flowing through the influence zone; (d) removing waste water from the conduit, including removing waste water in sufficient quantity to cause water to flow from the influence zone into the conduit; (e) lessening that amount of waste water flowing into the conduit.

In further accord with the invention, the manipulated variable being controlled is qualitatively different from the parameter being measured. For example, when the temperature is controlled by raising or lowering the pressure of air supplied to the conduit, the parameter and manipulated variable are qualitatively different.

The foregoing and other objects, features and advantages of the present invention will become more apparent from the following description of preferred embodiments and accompanying drawings.

BRIEF DESCRIPTION OF THE DRAWINGS

FIG. 1 is a schematic of a control system for a leach field.

DESCRIPTION

The invention here uses technology which is disclosed is other of my patent applications, including: patent application Ser. No. 09/526,381, for Method and Apparatus for Treating Leach Fields, filed Mar. 16, 2000; application Ser. No. 10/053,284, for Heating a Leach Field; and, application Ser. No. 10/053,511, for Dewatering a Leach Field. The disclosures and drawings of the three foregoing patent applications are hereby incorporated by reference.

In the invention of the application Ser. No. 09/526,381, air or other reactive gas is flowed through the influence zone to beneficially affect the biochemical activity there. Various ways of causing air to flow through the influence zone are described. Among them are flowing atmospheric air into the leach field conduits, and then into the influence zone. The generality of the prior related invention is referred here to as Leaching Field Aeration, or LFA.

In the invention of the Ser. No. 10/053,511 application, the leach field is dewatered, to reduce the water or moisture content of the soil. That invention is primarily used when a leach field has failed; and, it facilitates and makes better the use of the other related inventions. In the invention of the related Ser. No. 10/053,284 application; a leach field is heated by various means, to increase the level of biochemical activity in the influence zone. All three of the related inventions can be used alone or in conjunction with one or both of the other inventions.

In the generality of the present invention, certain parameters in the leach field which are affected by the above inventions are measured and controlled, to beneficially affect the leach field in a feasible or effective way. The parameters may be controlled separately or simultaneously. They have certain interdependencies, so when they are simultaneously or sequentially controlled, a complex system results. Control of different types of parameters is described next.

Gas Content

In a properly performing influence zone, the Oxygen Demand is met. The term "Oxygen Demand" is an environmental engineering characterization of how much oxygen is needed to effectively treat the oxidizable constituents of a substance—here waste water, to make them relatively environmentally benign. Oxygen Demand (OD) is usually characterized by measuring Biological Oxygen Demand (BOD); alternately by measuring Chemical Oxygen Demand (COD). For waste water systems associated with habitations, BOD has been the commonly used parameter of reference and control. It is measured in accord with United States Environmental Protection Agency Standard 405.1. COD may be measured in the U.S. by the so-called Hach Method 8000.

Typical domestic waste water has a BOD of about 200–500 mg/l. There is usually a general correlation between the parameters for a particular type of waste water stream. Determining COD is the quicker method of the two. More preferably, the dissolved oxygen (DO) in the waste water, in the water stream or within the soil, is measured instantly by means of commonly available instruments. For control purposes, DO is found to be sufficient surrogate for BOD or COD in when DO content rises BOD or COD can be inferred to have decreased. Inferential measurements can also be made, e.g., by measuring total organic content in the waste water. See Metcalf & Eddy, Inc. "Wastewater Engineering" 3$^{rd}$. Ed. (1991) McGraw Hill, New York, especially chapter 3. A reference hereinafter to OD will be understood that such encompasses a reference to either of BOD or COD or DO, according to the user's choice of parameter.

Whether or not the OD is being met in the influence zone can be ascertained by taking samples and testing, and to the extent meters may be available, directly monitoring OD near a presumed boundary of the influence zone. More directly, the effectiveness of waste water treatment can be ascertained by measuring the in situ composition of the gas contained in the influence zone. For instance, the concentration of oxygen is measured intermittently of continuously by means of a probe and measuring instrument, where the probe is inserted at one or more selected points in the influence zone. Instruments are commercially available for instantly measuring gas composition. One kind of instrument for measuring oxygen and certain other gases mentioned next, and a preferred probe for use with it or some other gas sampling instrument, are described in U.S. Pat. No. 6,018,909. See also the Considine book, referenced below. A measuring device for determining the dissolved oxygen content of waste water in the influence zone is Model Y55 meter (Yellow Springs Instrument Co., Yellow Springs, Ohio, US).

The oxygen measurement is compared to a reference standard or set point that has been developed from experience with leach fields. Generally, the aim is to change a composition that is deficient in oxygen, to the extent of being biochemically significantly less than the volume percent oxygen in air, to a composition that approximates that of air. In one example, the reference point or target level for oxygen in the gas of a leach field might be 19–21% oxygen; and, a measured composition of 14–19% oxygen may increased in direction of the reference point by controlled use of some or all of the techniques described here and in the related applications.

Since the levels of other gases such as carbon dioxide, methane, hydrogen sulfide, etc., can be correlated with the desired biochemical activity in the soil and inversely with oxidation, the concentrations of those other gases may alternatively or additionally be measured as inverse surrogates for oxygen, and used for process control purposes. Thus, measurement of the gas content in the influence zone may show other gases having contents substantially different from the composition of air. For instance, carbon dioxide may exceed 2%, methane 1% and hydrogen sulfide 0.005%. In the invention, such compositions will be changed in the direction of the composition of air.

When the gas content, for example, oxygen, is measured, air or other active gas is flowed through the influence zone in accord with the teachings of the LFA patent application. Air is characterized as an active gas principally because of the role of oxygen on the biochemistry of the influence zone. Accordingly, other active gases may be used with or in substitution of air. For instance, oxygen or ozone enriched air may be used for better activity, and a oxygen-helium mixture may be used for a combination of greater fluidity and activity. Optionally, reactive substances such hydrogen peroxide, or gases such as ozone, may be introduced directly or indirectly (e.g., by using air being flowed into the conduit) into the influence zone to change the gas composition, based on a measurement of the gas composition of, and for action in, the influence zone. That is accomplished by conventional dosing devices, metering pumps, metering valves and the like.

When the means for changing gas composition is the preferred one, namely causing flow of atmospheric air or other active gas into the influence zone, then the flow rate and duration of flow is controlled. If an additive, such as hydrogen peroxide or ozone is added to the air or directly to the influence zone, then the fractional percent or total mass flow is controlled, as is the air flow. The quantity and duration of the flowing of air or other substance will depend on the time it takes to move the composition to the desired reference level.

Influence Zone Fluid Pressure

Conventional devices are used to measure air or water pressure, most simply by connecting the point of interest to a device such as a Bourdon-spring or elastic diaphragm type unit with a signal sender. For pressures, and for other measurements, sensible averaging or other data processing of measurements taken over time is used when appropriate.

As an example, a pressure probe is inserted into the influence zone when LFA is initiated, and the pressure inside the conduit is compared to the pressure in the influence zone, to provide an indication with respect to the flow that is being achieved. When a pressure in the conduit is not greatly different from the pressure in the influence zone, for instance if 3 inch water column (WC) is found in the conduit and 1 inch WC in the influence zone, reasonably good flow is indicated. However, where there is a large difference, e.g., 20 inch WC in the conduit vs. 0.05 inch WC in the zone, then control action is taken. The great difference in pressure, and the low influence zone pressure, indicate a high impedance and a comparatively impermeable influence zone, which may include a dense biomat. The action taken may be to raise the pressure in the conduit to induce more flow, or to raise the temperature of the air (if it is heated) to seek to induce more biochemical activity. Alternately, those actions can be seen to be ineffective, and flow of air may be ceased, so that the influence zone can be dewatered.

Temperature

The aim of heating of the influence zone is to increase biochemical activity. For every 10° F. increase in temperature the rate of biochemical activity is doubled. Generally, any significant rise is useful. Preferably, the temperature is raised or maintained in the range 50–100° F., more preferably 50–75° F. Temperatures above 120° F. are avoided because of adverse effects on microorganisms. The desired temperatures compare to typical average soil temperatures of 50–70° F. across the continental United States (and waste water temperatures of the same approximate order). Soil temperatures approaching 32° F. are not uncommon in colder regions during winter time.

If the temperature is substantially below the desirable temperature range, as can occur due to seasonal or climatic conditions, then it will be an aim in using the invention of the Atty. No. 2014 application to raise the temperature an amount that is biochemically significant. In this aspect, a temperature increase of about 1–2° F. is significant. A rise of the order of about 5° F. is considered substantial How high the temperature is raised is a function of the desired effect which is sought. The preferences are stated in the prior paragraph and related application. To determine the effect of raising temperature, and conversely, the need, measurement may be made of the reduction in oxygen demand of waste water as it flows within, or as it exits, the influence zone. See FIG. 7 of the Atty. No. 2014 application. Since influence zone temperatures ordinarily should not exceed 120° F., when hot air is supplied to the leach field, it ought not to greatly exceed 120° F.

The temperature in the soil of the influence zone is measured by various means. Included within such means are: inserting probes into the soil, which probes may be thermistors, thermocouples, RTDs, and the like. For control purposes, surrogate temperatures may be measured. For instance, the temperature of soil that is adjacent the influence zone, or the temperature of a chamber wall, may be measured.

Different means may be employed for adding heat, as described more fully in the Atty. No. 2014 application. Heating elements may be placed in, or in vicinity of, the influence zone soil, to heat the soil and waste water contained therein. For example, heating elements are placed adjacent to, and or beneath, and or within the conduits. In another embodiment, comparatively warm air is flowed into the conduits and thence into the soil that comprises the influence zone. In another embodiment heated fluid is delivered directly into the influence zone, as by pressurized perforated pipes placed within the influence zone.

When air or other fluid is being flowed into or through the leach field, the total heat added will be a function of the mass flow, the temperature of the medium being delivered, and the time of flow. Thus, those variables may be controlled to affect temperature. When resistance heating elements are used, the temperature, power level, and duration will be controlled.

The heat source for heating elements or hot air or hot water flowed into a leach field may be any of many familiar sources, such as fuel combustion, electric resistance heating, and the like. In another technique, heat for the leach field is extracted from a geothermal source, for example, the natural water table in the earth. The extracted heat is delivered to the influence zone by means of a circulating heat exchange liquid or the working substance (refrigerant) or a heat pump system. Controlling the output of such systems is well known.

Of course, to add heat and raise temperature usually means raising operating cost. Therefore, in another aspect of the invention, the amount of heat is controlled so that it is not greatly more than is required. Thus, if measurement indicates the flow of waste water is lowered with respect to volume or oxygen demand, then the temperature of the field is allowed to decrease by lowering the heat input. This saves energy cost, since a lowered level of biochemical activity at any given point in the field can be found acceptable. In another mode of control, different portions of the field may be heated differently from time to time.

Water Content

Water content in a leach field is controlled by monitoring two different parameters: (a) by water level in the conduit and (b) by moisture content in the influence zone.

The water level and moisture content will vary with the loading or input to the system and the ability of the system to convey away the liquid. There may be momentary periods of overload, due to an episode of heavy use. Or there may be more systematic overload, as when the soil refuses to convey away the water which is delivered. The level of water in conduits is measured by use of any of a variety of common liquid level detection systems may be used, such as floats, capacitance gages, and conductivity meters. The level is monitored with respect to a certain pre-determined set point, which point would likely be less than a full conduit.

The waste water level in the conduit is monitored and controlled either directly or indirectly. Water level is directly manipulated by diverting part or all of the waste water flow to another part of the leach system or to a storage tank or the like, by means of valves, distribution box "levelers", and other know flow control devices. Of course, if possible water consumption at the source may be modified. Alternately, water may be removed from the conduits and any septic tank, to cease flow to the influence zone temporarily, while waste water accumulates. Quite often, the entire waste water system has a problem there is no where to meaningfully divert waste water and indirect means must be used.

The water content can be controlled indirectly, as some of the following examples indicate. When the pre-determined action point for water level or moisture content is reached, one or more of several actions or mechanisms are activated:

a. Flow of air through the conduit and influence zone is activated by turning on a blower; or existing blower-flow is increased by raising the pressure applied to the leach field component be used, e.g., the conduit or a buried auxiliary air pipe in proximity to the influence zone. The desired effect is that air flow enhances the biochemical activity in the influence zone, and reduces excess organic matter contained therein, so that flow of waste water is increased.

b. The temperature of the influence zone is increased, by thermal input into leach field. This is done by activating (or increasing the effect of) heating elements, or raising the temperature of air which is flowing through the leach field.

c. The quantity of a reactive substance such as ozone, added to air flowing into the conduit, is increased or activated, as the case may be.

d. The water flow to part or all of the conduit of the leach field is ceased, and pumping of suction is applied to the conduit, to draw water from the conduit and to cause water to flow from the influence zone, back into the conduit, to dewater the influence zone.

The above exemplary actions, and others within the teachings of the related applications will be undertaken separately or in combination. The intensity and duration of any action will be controlled according to what is observed in change in water content parameter.

The water content in the soil of the influence zone, may be measured and controlled as described in the Atty. No. 2032 application alone or in combination with conduit water level. The amount of moisture in the influence zone soil is measured by means of an electrical conductivity or capacitance type instrument, and the measurement is compared to a desired reference point, or pre-determined action point. For example, an Aqua-Tel-TDR dielectric type moisture sensor (Automata, Inc., Nevada City, Calif., US) is used. As an example, the set point for moisture content might be in the 40–60% moisture content range, where 100% would represent soil that is fully saturated with water.

While the moisture content in the influence soil is usually correlated with the water level in the conduit, with respect to levels of saturation, the two variables may or may not be correlated. For instance, if the biomat layer becomes rather impermeable, the average influence zone may be less than 100% moisture, whereas the conduit may be full of water.

In another aspect of the invention, the air pressure applied to the leach field in practice of LFA is periodically lowered or ceased, to enable intermittent flow of waste water. This process is employed when air pressure is continuously applied to the leach field conduit, but the air pressure is greater than the head of the water which is entering the leach field from the source, e.g., a septic tank. In such instance, the check valve which keeps air from flowing back to the source, will not open. Thus, the level of water in the septic tank is monitored. When it rises above a pre-determined point, the air flow is ceased or reduced in pressure sufficiently, to allow the level to fall; then the air flow is resumed. In another approach, the air pressure is lowered on a periodic basis by a timer, based on experience with the system.

In still another aspect of the invention, the leach field is fed waste water by a dosing pump. In such a system, waste water collects in a reservoir or sump, and is periodically pumped into the leach field. In preferred practice, the flow or air, or other factor being controlled, is correlated with the dosing action, as by monitoring the dosing pump activation and resultant flow. For example, the air pressure (or vacuum, as taught in the previously filed Ser. No. 09/526,381 application) and resultant air flow is applied in alternation with the pumping action.

Other Parameters and Sensors

Interwoven with the above, and thus implicit, is to control, the various input variables to the leach field by means of the monitoring other parameters which are not in the leach field itself, but are reflective of it's behavior. For instance, OD of water at or beyond the boundaries of the leach field influence zone or leach field as a whole may be measured, as an indicator of the overall performance of the field; the atmosphere air temperature may be measured as an indicator of the soil temperature in the leach field.

Various other sensors and control means may be employed, beyond the examples given above. For known different ways of measuring and controlling, in substitution of the examples, and for examples not given, see the book by G. McMillan, "Process/Industrial Instruments and Controls Handbook" (1991) McGraw Hill, NY.

Control System

From the foregoing, it will appreciated that for any given parameter being measured, the manipulated variable being controlled may be qualitatively different. This has been in part referred to as indirect control above. For example, when the temperature in the influence zone is controlled by raising or lowering the temperature of air flowing into the conduit and through the leach field, then the parameter and the manipulated variable are qualitatively the same. When the temperature is controlled by raising or lowering the pressure of air supplied to the conduit, the parameter and manipulated variable are qualitatively different. When the oxygen content of the influence zone is controlled by flowing air into the influence zone, there is a qualitative similarity. When the oxygen content is changed by changing the temperature, there is a qualitative difference.

When parameters which are being measured and then affected by controlling the action of the manipulated variables, sensor measurements and control functions are preferably continuous; and, a control system is automated to achieve such. When the system is automated, as by electrical or pneumatic processors, standard control technology is preferably used, e.g., proportional plus reset and proportional plus rate control actions are used. For example, the driver of the control system outputs a control signal proportional to the degree of deviation measurement parameter from the reference point, so the resultant driven action or control step is proportioned to the difference between the measurement and the desired reference level of the parameter. Suitable algorithms suggested by the examples herein will be programmed into a computer of a control system. In the generality of the invention, the measurement and control may be intermittent and manual. Optionally, manual data is entered into a control system. Familiar drivers and means for controlling or actuating are used, including on-off control, varying motor speed or power level to a device, adjustable valves, throttling, etc.

FIG. 1 shows schematically the elements of an example of automated leach field measurement and control system, where the system comprises a septic tank source. The system is configured for measuring and influencing certain parameters by manipulated certain variables. In other embodiments, greater or lesser numbers of parameters and variables, as may be inferred from the description above, will be respectively measured and controlled. The operation of the system in FIG. 1 is illustrative of the generality of the measuring and controlling modes. In FIG. 1 waste water (w) flows through septic tank 98 to leach field 100 within which are conduits 102. Air (a) flows through air mover 104 to heater 106 to conduits 102 within leach field 100. Sensors 108, 110 measure respectively pressure and temperature in the influence zone and provide signals (s1). Sensors 112 and 114 measure respectively pressure and temperature of the air and provide signals (s2). Signals (s1) and (s2) run to the processor 116 of controller 120. Processor 116 compares the temperature signal (s1) from the leach field to the input reference temperature; if below the reference, through driver 118, controller 120 provides signal (s2) to activate the heater. Signal (s2) of the heated air is compared to a reference limit temperature, and if above, action of the heater is limited. Alternately, the blower pressure is increased to increase air flow. Pressure signal (s1) from the influence zone is compared to pressure sensor signal (s2) from the air line running out of the air heater (which reflects essentially the same pressure as inside the hollowness of the conduit) and the difference is compared to a difference reference input. If the comparison is greater than the comparison reference difference the pressure is increased to induce more flow and a higher pressure in the influence zone. Pressure signal (s1) from the influence zone is also compared to an absolute pressure reference; if less than the reference, flow of air (a) is maintained or pressure is increased. When the absolute pressure and or the pressure difference criterion is satisfied, the input air pressure is sustained or reduced. Based on signals (s1) and an internal clock, and the trend of influence zone pressure upward, processor 116 signals additive injector 122 to flow chemical (c), such as ozone, into the air stream running into the conduit and thence the influence zone.

The following are examples of the practice of the invention.

A. The leach field has a blower and associated air heater, to apply air to the conduit by injecting it into the distribution box. A check valve prevents air from flowing back to the source septic tank when air is applied to the distribution box and conduits. The blower and heater system has the usual sensing and control system, for measuring blower pressure and air temperature, where they are fed to the distribution box. One or more sensors for oxygen content are imbedded in the soil within the influence zone. The blower runs in an on-off mode according to whether the measured oxygen content in the leach field is above or below a set point.

B. The system is set up like Example A, however, temperature sensors are used instead of oxygen sensors, and the blower action and flow of heated air is turned on-off according to a temperature reference level. In variations of A and B, both variables are controlled; a modulated control system is employed and blower speed varies with the amount of offset from the set point. In a further variation, there is no dedicated heater, but warm air is drawn by the blower from the heated air space within the building being served.

C. The leach field has a blower only, to provide air to a distribution box, and there is a check valve, etc., as in Example A. The blower draws air from the heated interior of a dwelling. A float switch is set within the interior of a conduit that is an arch shape chamber 18 inch high. The float switch is closed when water level rises above 6 inches. It is opened when water level falls to 2 inches. The blower is normally off. When the float switch indicates that the level has risen to 6 inches, the blower is activated, to apply air pressure to the conduits. With time, the air increases the capacity of the influence zone to process, and convey away, waste water. When the water level falls to 2 inches, the blower shuts off. In a variation, the blower has a heater and there is another water level sensor for 8 inch depth, if the water level continues to rise despite the action of the blower, the heater is activated, to warm the air. In a still further variation, the energy to the heater, and temperature of the flowing air is increased over time if the sensor shows water level continues to rise.

The principles and teaching of the invention are useful for testing, i.e., monitoring, evaluating and comparing, the condition of a waste water processing system, particularly a system which does not have the obvious and common parameters of failure, mentioned in the Background. The aim here is to acquire information and no control action is taken. Basically, other than testing the waste water for pollutants, they tend to be go-no go types of measures. Thus, for example, it is not known to monitor the performance of a leach field system by measuring soil gases (as compared to gases which are dissolved in the waste water); and, that is done in the testing invention. In another example, air is flowed through the conduit and into the leach field so that by measuring the pressure in the influence zone on an absolute basis, for comparison to the input pressure which is causing flow. The degree to which the field is saturated or clogged can be determined. In another example, air is pulled through the soil of the influence zone, to determine the resistance of flow. For instance, a probe connected to a vacuum pump is inserted into the soil and the resistance to flow of air into the probe is determined, as by measuring the flow rate as a function of the degree of vacuum in the probe. This will give an indication again of saturation or clogging.

The inventions will be useful with all manner of conduit in leach fields, as the definitions and descriptions in the related applications illustrate. They will be useful as well for sand filters, wherein typically waste water is flowed onto a bed of sand or like granular media from dosing pipes (conduits) which are embedded in the upper layer of the sand bed, or suspended above the surface of sand bed.

Although this invention has been shown and described with respect to a preferred embodiment, it will be understood by those skilled in this art that various changes in form and detail thereof may be made without departing from the spirit and scope of the claimed invention.

I claim:

1. A method of improving or maintaining the performance of a waste water system comprised of a leach field having a conduit buried within soil, wherein waste water is flowed into the conduit and then into an associated influence zone in the soil in which zone the biochemistry of the waste water is made more environmentally benign, by means which includes flowing of air or other active gas through the influence zone, which comprises:

sensing a property of a fluid contained within said conduit;

comparing said fluid property to a desired reference point;

controlling the flow of air through the influence zone to cause the sensed fluid property to be less than said desired reference point.

2. The method of claim 1 wherein said fluid property is the pressure of gas.

3. The method of claim 1 wherein said fluid property is the level of waste water.

4. A method of improving or maintaining the performance of a waste water system comprised of a leach field having a conduit buried within soil, wherein waste water is flowed into the conduit and then into an associated influence zone in the soil in which zone the biochemistry of the waste water is made more environmentally benign, by means which includes flowing of air or other active gas through the influence zone, which comprises:

sensing gas pressure in a conduit;

comparing the gas pressure to a desired reference point;

controlling the flow of air through the influence zone, to cause the measured gas pressure to be less than said desired reference point.

5. The method of claim 4 wherein the step of controlling comprises turning the flow of air on and off.

6. The method of claim 4 wherein the step of controlling comprises varying the pressure of the air being flowed.

7. A method of improving or maintaining the performance of a waste water system comprised of a septic tank and a leach field comprising a conduit buried within soil, wherein waste water is flowed into the conduit and then into an associated influence zone in the soil in which zone the biochemistry of the waste water is made more environmentally benign, by means which includes flowing of air or other active gas through the influence zone, which comprises:

sensing gas pressure in a conduit;

comparing the gas pressure to a desired reference point;

controlling the flow of air through the influence zone, to cause the measured gas pressure to be less than said desired reference point.

8. The method of claim 7 wherein the step of controlling comprises turning the flow of air on and off.

9. The method of claim 7 wherein the step of controlling comprises varying the pressure of the air being flowed.

* * * * *